US007224916B2

(12) United States Patent
Iwakawa

(10) Patent No.: US 7,224,916 B2
(45) Date of Patent: May 29, 2007

(54) IMAGE FORMING APPARATUS USING TONER CONTAINING WAX WITH IMAGE DENSITY DETECTING MEANS USED FOR IMAGE DENSITY ADJUSTMENT

(75) Inventor: Tadashi Iwakawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/144,595

(22) Filed: Jun. 6, 2005

(65) Prior Publication Data

US 2005/0271404 A1 Dec. 8, 2005

(30) Foreign Application Priority Data

Jun. 7, 2004 (JP) ..... 2004-168468

(51) Int. Cl.
*G03G 15/00* (2006.01)

(52) U.S. Cl. ..... 399/49

(58) Field of Classification Search ..... 399/49, 399/40, 41

See application file for complete search history

(56) References Cited

U.S. PATENT DOCUMENTS 4,655,582 A * 4/1987 Okuda et al. ..... 399/402
2005/0271404 A1 12/2005 Iwakawa ..... 399/49

FOREIGN PATENT DOCUMENTS

JP 10-268589 A 10/1998
JP 2000-132013 A 5/2000

* cited by examiner

*Primary Examiner*—Quana Grainger
(74) *Attorney, Agent, or Firm*—Fitzpatrick, Cella, Harper & Scinto

(57) ABSTRACT

The image forming apparatus including a heat roller fixing apparatus for heat-fixing an image obtained through development using toner to a recording medium, and a density sensor for detecting density of the image after the fixing, the image forming apparatus serving to adjust image density based on image density detected by the density sensor, in which the density sensor is disposed in a position where a temperature of the image being conveyed within a conveying path is equal to or lower than a coagulation temperature (melting point) of the toner.

2 Claims, 5 Drawing Sheets

IMAGE FORMING APPARATUS USING TONER CONTAINING WAX WITH IMAGE DENSITY DETECTING MEANS USED FOR IMAGE DENSITY ADJUSTMENT

BACKGROUND OF THE INVENTION

1. Field of the Invention

The present invention relates to an image forming apparatus such as a copying machine, a printer, or a facsimile, for forming an image by utilizing an electrophotographic system, and more particularly, to an image forming apparatus for detecting density of an image formed on a recording material after the image is heated to adjust the density of the image.

2. Related Background Art

As well known, in an image forming apparatus utilizing an electrophotographic system, a visualized image borne on a photosensitive member or a transfer member is transferred to a recording medium such as a piece of plain paper to obtain a recorded image. Thus, the recording medium, to which the visualized image is transferred from the photosensitive member or the transfer member, is conveyed to a fixing apparatus so that the visualized image is fixed thereon by the fixing apparatus, and then the resultant recording medium is discharged.

In recent years, there has been a growing demand for improved high image quality, high stabilizations and the like. With this being the situation, in order to constantly maintain density of an image formed by an image forming apparatus in a proper state, many techniques have been proposed in each of which a reference image having predetermined density is formed to measure its density, an obtained density measured value is compared with a density target value to create a conversion table, and density characteristics of image data are converted using the created conversion table, thereby controlling the density of the image.

As regards a method of measuring density of a reference image required for such density control, there has been known a method in which density of a toner image formed as the reference image is measured before the toner image is transferred to a recording medium, and a method in which density of the toner image which has been transferred to the recording medium but yet to be fixed thereon is measured. However, with those density measuring methods, fluctuations in transfer amount of toner to the recording medium, a degree of fixing of the toner to the recording medium, and the like lead to cause a difference between the density of the actually obtained image and the density of the measured image. As a result, the density could not be controlled with high accuracy.

For this reason, a method has also been proposed in which an image forming apparatus causes its image reading apparatus to read an output image, to thereby control the density based on the readout results. However, according to this method, it has been necessary to set the output image in the image reading apparatus, which has been troublesome. In addition, in the image forming apparatus not including such an image reading apparatus as in a case of a printer, the density could not be adjusted.

Therefore, as for a conventional image forming apparatus, there has been known an apparatus as shown in FIG. 5 in which a density sensor 109 is provided in a recording medium conveying path directly behind a fixing apparatus 108, and density is adjusted based on the density of an image after completion of a fixing process (e. g., refer to Japanese Patent Application Laid-Open No. 2000-132013). Note that, in FIG. 5, reference numeral 101 designates a photosensitive drum, reference numeral 102 designates a laser exposure optical system, reference numeral 104 designates a cleaning device, reference numeral 105 designates a developing apparatus, reference numeral 111 designates a primary charger, and reference numeral 112 designates a transferring charger.

In addition, there has been known an image forming apparatus as shown in FIG. 6 in which a density sensor 209 is provided in a reverse conveying path portion R3 that follows a fixing apparatus 208, to thereby carry out density adjustment (e.g., refer to Japanese Patent Application Laid-Open No. H10-268589). Note that, in FIG. 6, reference symbols 201*k*, 201*y*, 201*m*, and 201*c* designate photosensitive drums, and reference numeral 203 designates an intermediate transferring member.

Note that in each of the above-mentioned image forming apparatuses, toner contains no wax for enhancing a releasing property from fixing means. However, when it is assumed that the wax is contained in the toner in each of the above-mentioned conventional image forming apparatuses, the following problem arises. That is, since the density sensor is disposed just next to the fixing apparatus, the wax is in a liquid state in the fixed image detected by the density sensor due to the heating during the fixing process. Thus, a progress on coagulation of the wax differs depending on the density degrees of images. For this reason, when the density is measured using a light reflection type density sensor, an amount of reflected light differs depending on the progress on coagulation of the wax, which leads to vary measurement results accordingly. As a result, even when the image density in this state is detected for the measurement, a measured value may vary each time the density is measured. Thus, the density cannot be adjusted with high accuracy.

Accordingly, in a case where a plurality of patches (images) having different density degrees are used as the reference images for the image density adjustment, each of density measured values obtained based on a plurality of patches is compared with a density target value to create a conversion table, and the density characteristics of the image data are converted using the conversion table thus created, thereby controlling the density of the image, it takes long time for a temperature of the wax to decrease to a coagulation temperature (melting temperature) when the image density is high. Hence, the progress on coagulation of the wax differs depending on the patches, and thus a difference between the density measured value and the density target value varies depending on the density of the patches. This becomes a factor by which the accuracy of the density adjustment further gets worse.

SUMMARY OF THE INVENTION

The present invention has been made in the light of the above-mentioned problems, and it is, therefore, an object of the present invention to provide highly accurate and stable performance of density adjustment in an image forming apparatus for detecting density of an image on a recording material after the image is heated, thereby adjusting the density.

According to another aspect of the present invention, there is provided an image forming apparatus, including: image forming means for forming an image on a recording material using toner containing wax; heating means for heating the image formed on the recording material by the image forming means; a conveying path along which the recording material heated by the heating means is conveyed; density detecting means disposed in the conveying path for detecting density of the image on the recording material heated by the heating means; and adjustment means for adjusting the density of the image formed on the recording material, based on detection results detected by the density detecting means, wherein the density detecting means is disposed in a position where a temperature of the wax heated by the heating means is equal to or lower than a coagulation temperature of the wax.

Other objects of the present invention will become clear by referring to the accompanying drawings.

DESCRIPTION OF THE PREFERRED EMBODIMENTS

An embodiment of the present invention will hereinafter be described based on the accompanying drawings.

Figure 1:
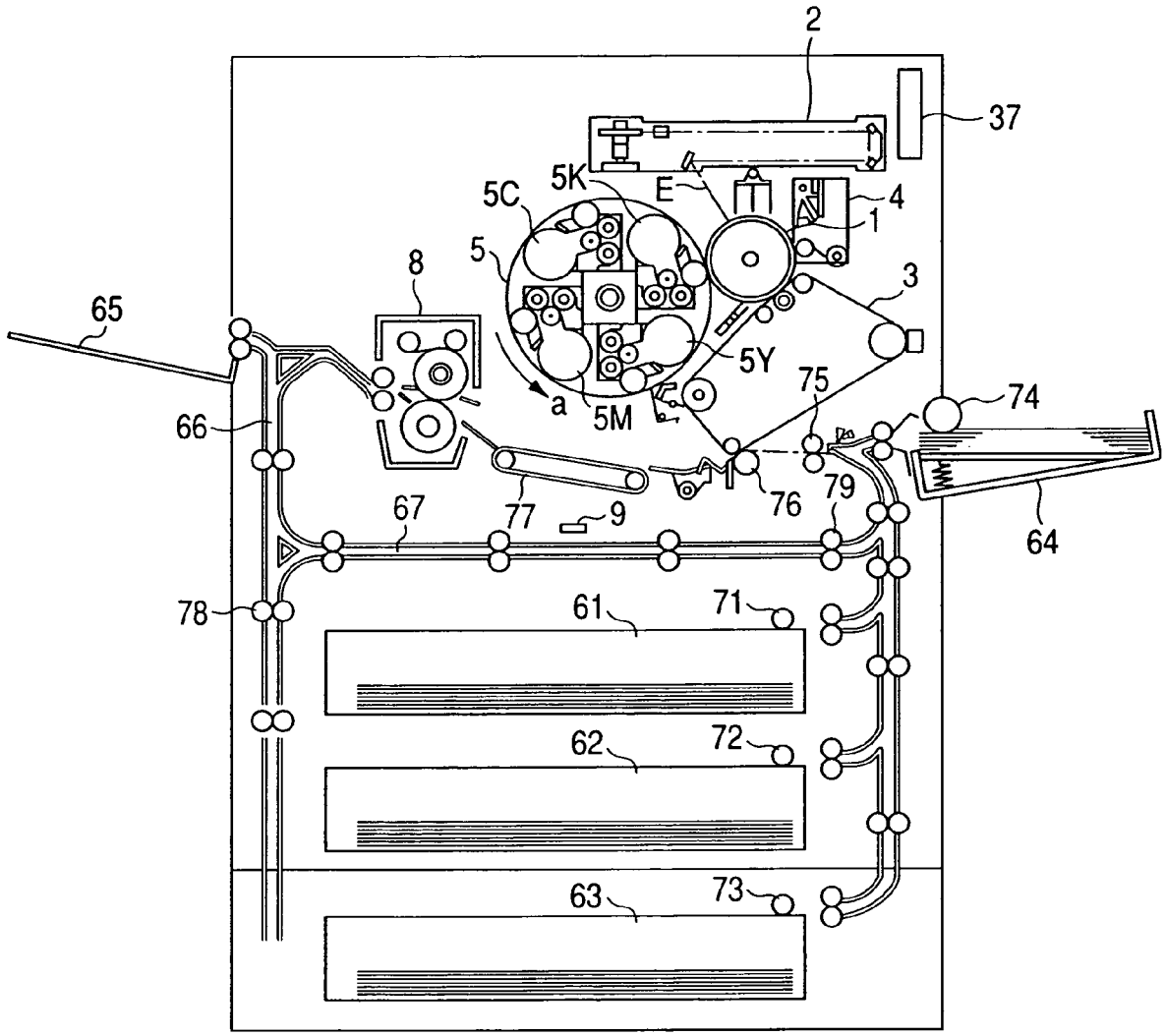
FIG. 1 is a main cross sectional view of an image forming apparatus according to the present invention.

FIG. 1 is a schematic cross sectional view of an image forming apparatus according to the present invention. In FIG. 1, reference numeral 1 designates a photosensitive drum as an image bearing member, which is rotatably supported. A pre-exposure lamp, a corona charger, a laser exposure optical system 2, an electric potential sensor, an intermediate transferring member 3, a cleaning device 4, and a rotation type developing apparatus 5 are disposed around the photosensitive drum 1, and serve as image forming means.

The rotation type developing apparatus 5, which is rotatable, includes developing devices corresponding to four colors, i.e., a black developing device 5K, a yellow developing device 5Y, a magenta developing device 5M, and a cyan developing device 5C. The rotation type developing apparatus 5 is adapted to rotate around a cylindrical rotation axis provided in a center thereof in a direction indicated by an arrow a (in a counterclockwise direction) in FIG. 1. Thus, the rotation type developing apparatus 5 can move the developing device corresponding to a desired color to a development position facing the photosensitive drum 1 as may be necessary.

In addition, in the laser exposure optical system 2 and an image processing portion 37 as adjustment means for adjusting density of an image, an image signal sent from a reader portion is subjected to an image processing so as to obtain a desired image formation condition (desired image density), and is then converted into an optical signal in a laser outputting portion. A laser beam which is obtained in the form of the optical signal through the conversion is reflected by a polygon mirror to be projected on a surface of the photosensitive drum 1 through a lens and reflecting mirrors.

Figure 7:
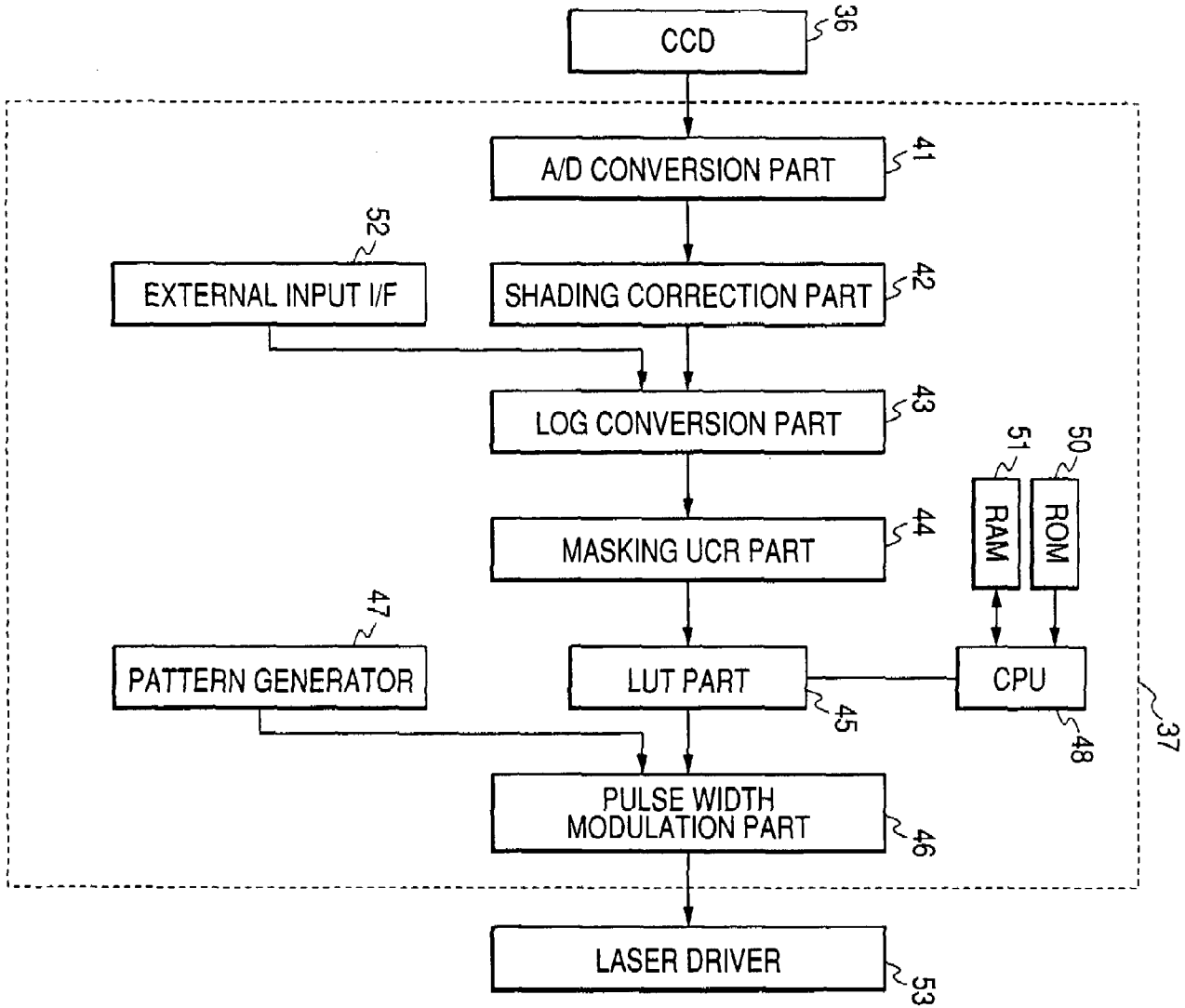
FIG. 7 is a block diagram showing a configuration of an image processing portion in an example of the present invention.

FIG. 7 shows a block diagram of the image processing portion 37. The image processing portion 37 includes an A/D converting portion 41, a shading correcting portion 42, a LOG converting portion 43, a masking UCR portion 44, a look-up table (LUT) portion 45, and a pulse width modulating portion 46. In addition, a pattern generator 47 is connected to the pulse width modulating portion 46, a CPU 48 having a ROM 50 and a RAM 51 is connected to the LUT portion 45, and an external input I/F is connected to the LOG converting portion 43. The image signal which has been subjected to the image processing in the image processing portion 37 is outputted to the laser outputting portion.

The image forming apparatus according to this embodiment of the present invention creates a look-up table (updates image formation conditions) based on information on density of an image on a recording material after completion of the heat-fixing process, in order to satisfactorily maintain image quality of a full-color image, especially, in terms of color tint and gradation, and carries out the image formation based on the look-up table thus created. The information in the look-up table (LUT) which has been updated last time is stored in the RAM 51 as storage means (memory means). The CPU 48 instructs the image forming means to carry out the image formation using the look-up table having the information updated last time.

In this embodiment, the image forming apparatus can select a mode in which the density adjustment is carried out. When intending to carry out the density adjustment, a user selects a density adjustment mode selecting button (not shown). Thus, the user sets a predetermined recommended sheet of paper in a sheet feeding portion, and causes the image forming apparatus to form an image for density adjustment on the recommended sheet of paper. Then, the look-up table is created (the image formation conditions are updated) based on the image density information on the recording material after completion of the hest-fixing process.

Then, during the image formation, the photosensitive drum 1 is rotated, and the photosensitive drum 1, electric charges on which have been discharged using the pre-exposure lamp, is uniformly charged with electricity by the corona charger. After that, a light image E of a first color, e.g., yellow is applied to the photosensitive drum 1 to form a latent image on the photosensitive drum 1. Next, the latent image formed on the photosensitive drum 1 is developed by the yellow developing device 5Y to form an image of yellow toner containing a resin and a pigment as a base substance on the photosensitive drum 1.

After that, the yellow toner image which has been formed on the photosensitive drum 1 is primarily transferred to the intermediate transferring member 3.

After completion of the developing process for yellow as the first color, the rotation type developing apparatus 5 rotates in a direction indicated by an arrow a in FIG. 1 by 90° to move the magenta developing device 5M for magenta as a second color to the development position facing the photosensitive drum 1. The photosensitive drum 1, which has been cleaned by the cleaning device 4 after completion of the primary transferring process of the yellow toner image, repeatedly performs the latent image forming process, the developing process, and the primary transferring process with respect to magenta as the second color, cyan as the third color, and black as a fourth color, similarly to a case of yellow as the first color to successively superpose the respective toner images on the intermediate transferring member 3.

Here, the toners having the respective colors are supplied from toner containing portion to the developing devices 5K, 5Y, 5M, and 5C whenever necessary at a desired timing so that toner ratios (or toner amounts) in the respective developing devices 5K, 5Y, 5M, and 5C are held constant.

On the other hand, the recording medium as the recording material is conveyed one sheet by one sheet from any one of containing portions 61, 62, 63, and 64 by any one of sheet feeding means 71, 72, 73, and 74, and is then corrected with its skew feeding by registration rollers 75. After that, the recording medium is conveyed to a secondary transferring portion 76 at a desired timing, and the composite toner image on the intermediate transferring member 3 is transferred to the recording medium in the secondary transferring portion 76.

The recording medium to which the composite toner image has been transferred in the secondary transferring portion 76 passes through a conveying portion 77 to be conveyed to a heat roller fixing apparatus 8 as heating means. After the composite toner image on the recording medium is fixed (image heating) in the heat roller fixing apparatus 8, the recording medium is discharged to a delivery tray 65 or a sheet after-treatment apparatus (not shown).

In addition, when an image is intended to be formed on both sides of the recording medium, after the recording medium passes through the heat roller fixing apparatus 8, a conveying path switching guide is immediately driven to temporarily guide the recording medium to a reverse conveying path 66. After that, the recording medium is made recede in a direction opposite to the feeding direction with its trailing edge during the feeding as the front, based on a reversal operation by reversal rollers 78, to be fed to a duplex conveying path 67. After that, the recording medium which has passed through the duplex conveying path 67 is corrected with its skew feeding in the duplex conveying roller 79 as the conveying member is then temporarily stopped for timing adjustment. The recording medium is then conveyed to the registration rollers 75 at a desired timing, and the image is then transferred to the other side of the recording medium again through the above-mentioned image forming process.

Next, a constitution of image density adjustment will be described based on FIGS. 2 to 4.

Figure 2:
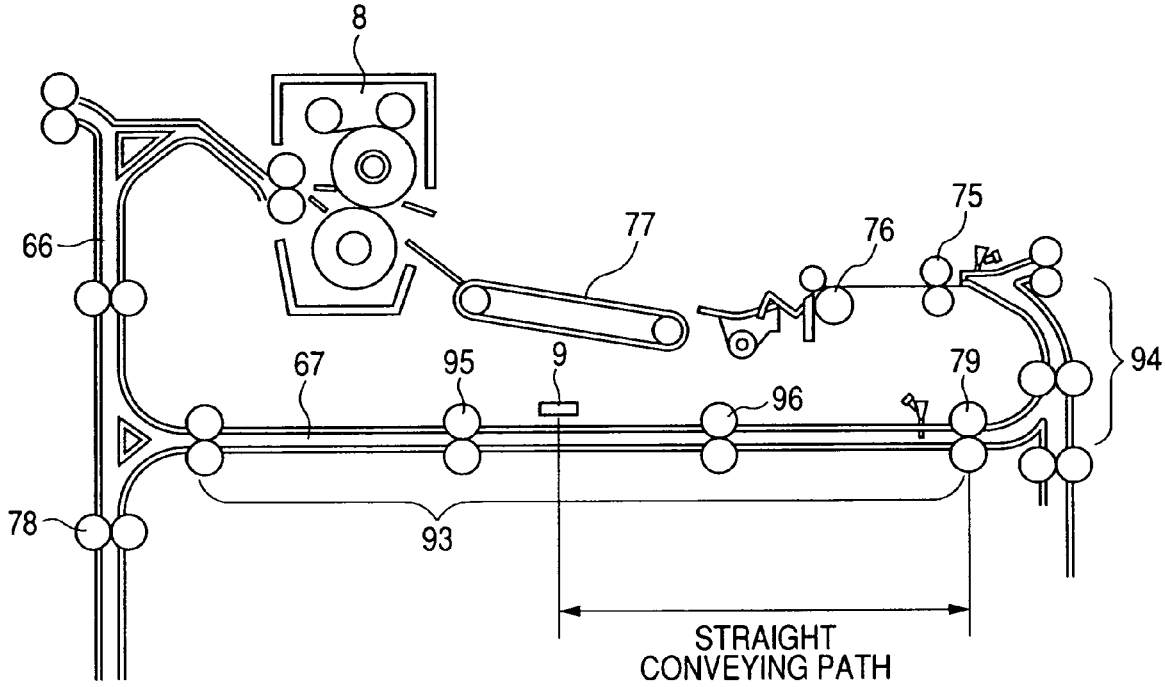
FIG. 2 is a cross sectional view of a density sensor disposition portion in a recording medium conveying path of the image forming apparatus according to the present invention.
Figure 3:
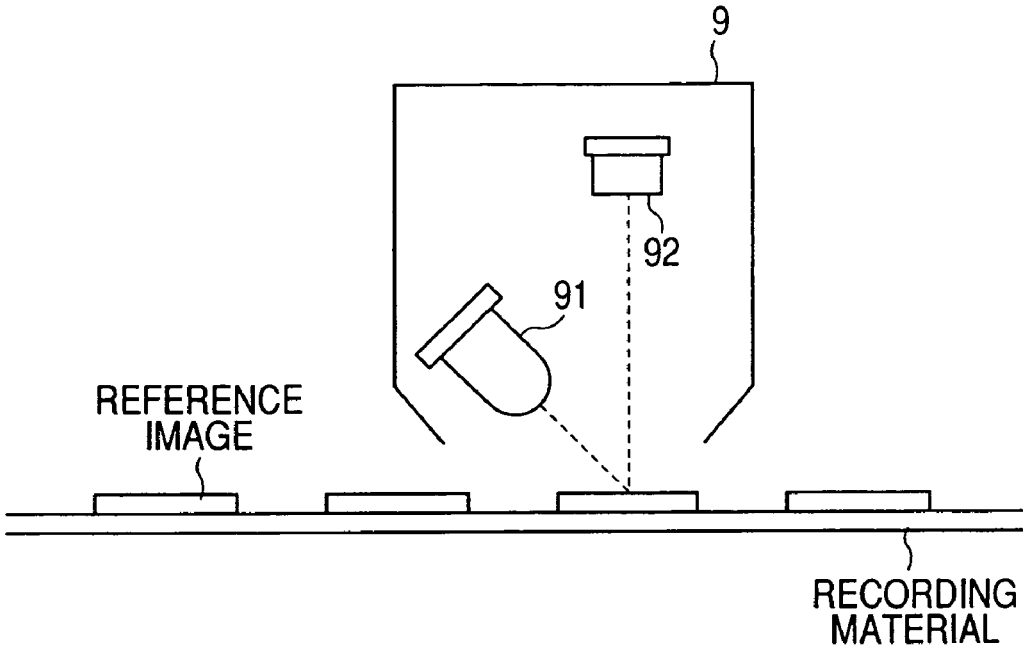
FIG. 3 is a cross sectional view of a density sensor and a recording medium of the image forming apparatus according to the present invention.

FIG. 2 is a partial cross sectional view showing disposition of a density sensor in a recording medium conveying path; FIG. 3 is a cross sectional view of the density sensor and the recording medium; and FIG. 4 is a graphical representation showing a relationship between an image temperature and time.

During the image density adjustment as well, similarly to the normal duplex image formation described above, the latent image forming process, the developing process, and the primary transferring process are repeatedly carried out to secondarily transfer the composite toner image to the recording medium which has been conveyed to the secondary transferring portion 76. Then, the composite toner image which is secondarily transferred to the recording medium is fixed in the heat roller fixing device 8. When the conveying path switching guide is driven, the recording medium passes through the reversal conveying path 66 to be reversed and is then fed to the duplex conveying path 67.

Here, the image formed is a reference image having predetermined density. As shown in FIG. 3, reference light is applied to the reference image on the recording medium which has been conveyed, by irradiating means 91 provided within a density sensor 9. Reflected light of the reference light is received by light receiving means 92 which outputs in turn a signal corresponding to a quantity of received light. The image processing portion 37 as the adjusting means compares a density measured value obtained from an output value of the density sensor 9 with a density target value to create a conversion table, and converts the density characteristics of the image data using the conversion table thus created to carry out the density adjustment.

In this embodiment, the density sensor 9 for detecting the density of an image on the recording material includes an LED for emitting near infrared light as a light emitting device, and a photodiode as a light receiving device. The density sensor 9 detects reflected light from the image heat-fixed on the recording material to detect the density of an image. The image formation conditions are changed based on the detection results of the density sensor 9, thereby carrying out the density control.

Next, toner (and a wax) will(be described. Toner to be used in this embodiment contains a paraffin wax as a wax to enhance releasing property. Here, components of the toner and a method of producing thereof will be briefly explained. Of the toners to be used in the examples of the present invention, a cyan toner will be described as an example.

| | |
|---|---|
| Hybrid resin containing a vinyl-based polymer unit and a polyester resin unit | 100 parts by mass |
| Paraffin wax (melting temperature (melting point): 72° C.) | 9 parts by mass |
| C.I. Pigment Blue 15:3 | 5 parts by mass |
| Di-tert-butyl aluminum salicylate complex | 6 parts by mass |

All of the above components are sufficiently premixed by using a Henschel mixer, followed by being subjected to melting and kneading by using a biaxial extruder. The obtained product was cooled and then coarsely pulverized into pieces with a particle size of about 1 to 2 mm by using a hammer mill. Next, the resultant was finely pulverized with an air jet-pulverizing mill. The fine pulverized product was classified with a hyperfractionated classification apparatus, to thereby obtain cyan toner particles having a weight average particle size of 7.6 μm.

100 parts by mass of silica particles having a first particle size of about 20 nm were added with 1.1 part by mass, with respect to 100 parts by mass of the cyan toner particles described above, of hydrophobic silica particles (BET specific surface ratio=85 $m^2/g$) surface-treated with 7 parts by mass of hexamethyldisilazane, to thereby produce the cyan toner. Furthermore, the cyan toner were mixed with magnetic carrier particles (average particle size of 50 μm) in which the surface thereof is coated with a silicone resin to have toner concentration of 6 mass %, to thereby produce a binary developing agent.

In this embodiment, the toner is produced by a grinding method, but the method is not limited to this. It should be noted that any of well-known methods can be used, as far as the particles contain a mixture of toner and wax.

Here, the density sensor 9 is set in a conveying path to detect a density of a certain recording material in a recording material conveying path. The concentration sensor 9 is arranged at a position where a temperature of a wax which is formed on the recording material and heated by using a heat fixing roller apparatus is lower than the coagulation temperature of the wax (which also is the melting temperature (melting point) of the wax). (Hereinafter, the coagulation temperature of the wax will be referred to as the "melting point of the wax"). In the examples of the present invention, the melting point of the wax is 72° C. In the present invention, the coagulation temperature of the wax represents a temperature in which the wax at a liquid state transforms itself into a solid state (or vice versa). If the temperature is lower than the coagulation temperature, the wax is in a solid state. Therefore, when a density detection is performed at a lower temperature than the coagulation temperature, a situation can be prevented where results of a detection by a density sensor varies due to difference in surface natures of the toner phase state (a liquid state, a solid state, or the like).

Here, a method of measuring the melting point of a wax is explained. The melting point of the wax in toner is measured by the steps including: separating and collecting the wax by a THF melting and a heat-toluene melting; and measuring the melting point of the wax by using the differential thermal analysis (DSC) represented below.

(Measurement of Differential Thermal Analysis)

A measurement is performed by using a differential scanning calorimeter (DSC measuring apparatus), a DSC-7 (both are manufactured by Perkin Elmer), and a DSC2920 (manufactured by TA Instrument Japan) according to ASTMD3418-82. A measurement sample is precisely measured so as to be 2 to 10 mg, preferably 5 mg. The sample was placed in an aluminum pan, and a measurement was performed with a rate of temperature increase of 10° C./minute and measurement temperature in a range of 30 to 200° C. An empty aluminum pan was used as a reference. In the measurement, a temperature rise and a temperature decrease were performed at first, followed by a temperature rise again. At the process of the second temperature rise, an endothermic peak of a DSC curve appeared in a range of 30 to 200° C. is measured. At this time, a peak which exhibits the maximum value among one or several endothermic peaks is referred to as the largest endothermic peak, and it is defined as the melting point in the present invention.

In this embodiment, the wax to be used is a wax having one or several endothermic peaks when the temperature of the wax is in a range of 30 to 200° C., and having a peak temperature of 72° C. at the largest endothermic peak among those endothermic peaks.

Figure 4:
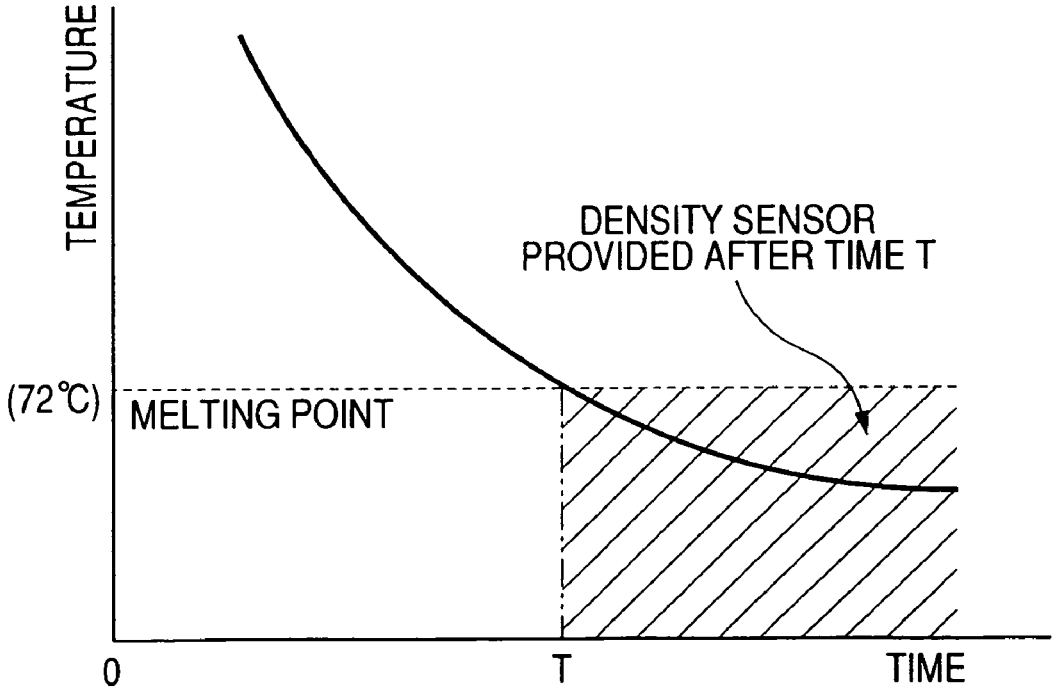
FIG. 4 is a graphical representation showing a relationship between an image temperature and time in the image forming apparatus according to the present invention.
Figure 5:
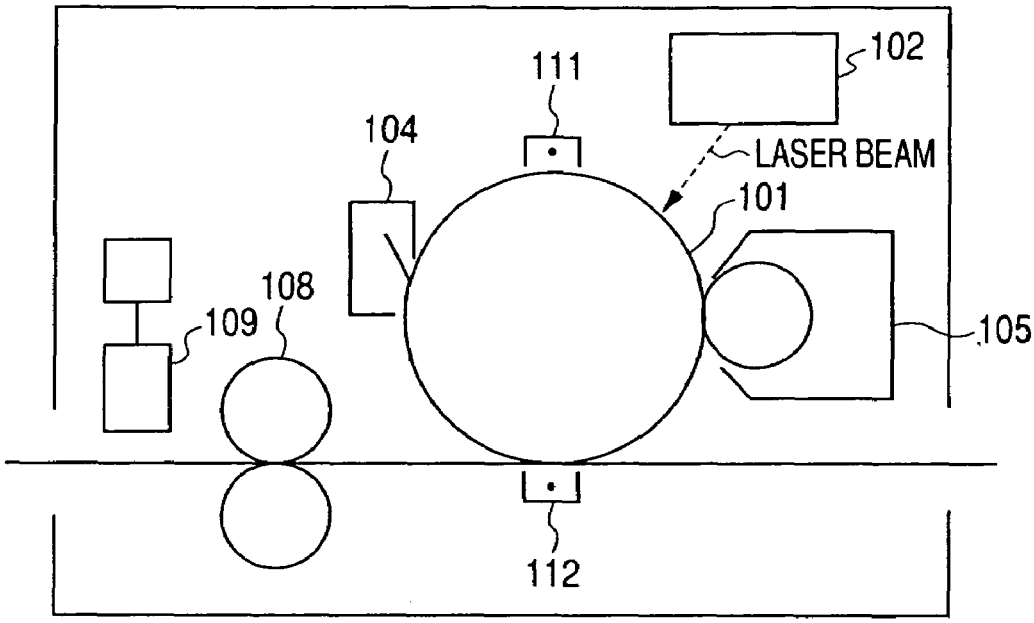
FIG. 5 is a cross sectional view of a conventional image forming apparatus.
Figure 6:
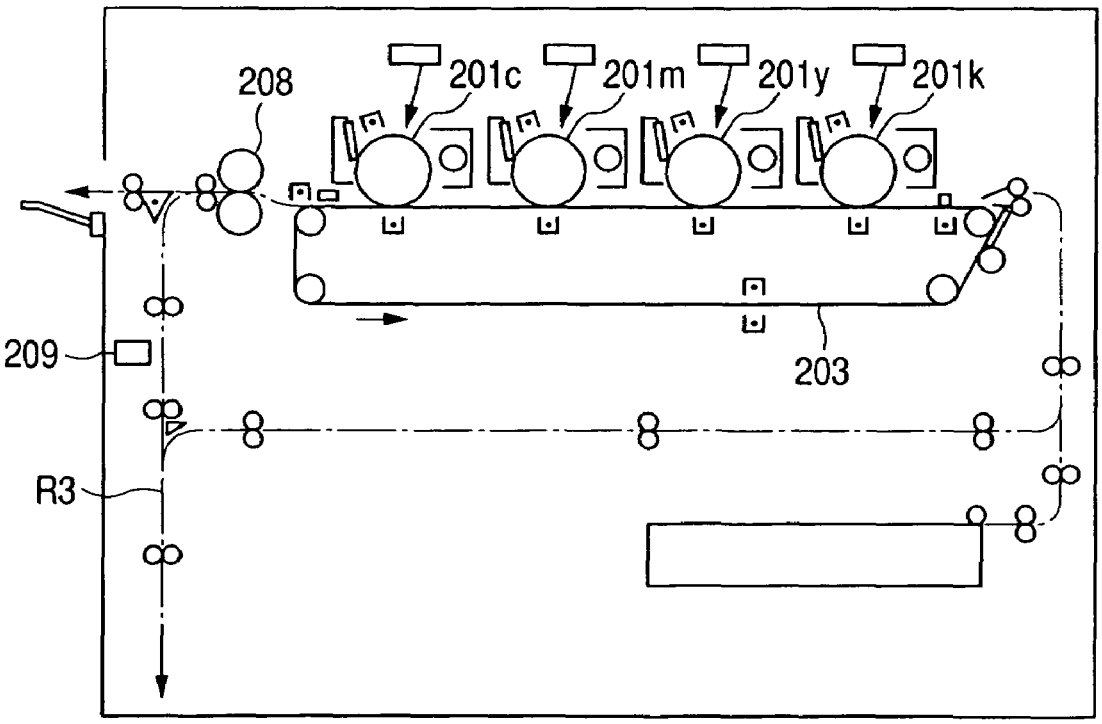
FIG. 6 is a cross sectional view of another conventional image forming apparatus.

Here, FIG. 4 shows a long term change of an image temperature. As shown in FIG. 4, the image temperature decreases with a lapse of time so as to draw a hyperbolic curve. Thus, the image temperature decreases to a melting point (72° C.) of the toner containing the wax at time T. Accordingly, the density sensor 9 is provided in a position where the time T or more elapses until the recording medium which has been passed through the heat roller fixing apparatus 8 reaches the density sensor 9 along the conveying path. The temperature of the wax on the recording material can be measured as follows. When a recommended sheet of paper for density adjustment can be prepared, the recommended sheet of paper is used as the recording material (when no recommended sheet of paper can be prepared, a color laser copier sheet of paper of an A4 size manufactured by CANON INC. (product code: 5548A002) is used as the recording material). Either a contact type temperature sensor or a non-contact type temperature sensor may be used as temperature measuring means for measuring a temperature of the wax. Also, the temperature of the wax can be measured with a commercially available infrared sensor or a commercial thermister. As regards the measurement atmosphere, a temperature is set to 23° C., and a relative humidity is set to 50%. Then, in a state in which the image forming apparatus is turned on to obtain an image formable state, and the image formable state is held for 10 minutes, the image for the density adjustment (toner patch) is formed on the recording material. The toner patch thus formed is heated by heating means, and then the temperature of the recording material (including an image formation portion) when the recording material is conveyed to a position (detection position) facing the density sensor 9 is measured using the temperature measuring means. At this time, the temperature measuring means is disposed so that an area to be measured using the temperature measuring means includes an area having the toner for the density adjustment formed thereon (an area the density of which is to be detected by the density sensor 9) of the overall area on the recording material. Here, a maximum temperature indicated by a certain measured value among all measured values measured using the temperature measuring means has to be lower than the melting point (coagulation temperature) of the wax. As a result of the experiments, the variation in detection results obtained by the density sensor could be prevented as long as the temperature of the wax was equal to or lower than its melting point. That is, even when the temperature of the wax is just the melting point, the variation in detection results can be prevented from occurring.

For this reason, when the density of the image is detected by the density sensor 9, most of the wax contained in the toner of the image has already been in a coagulation state. Thus, it is possible to prevent the variation in detection results due to the difference in progress on coagulation of the wax contained in the toner of the image. Consequently, the density of the reference image is stabilized, and thus the density can be adjusted with high accuracy based on the density of the reference image. In addition, the density sensor 9 is provided in the duplex conveying path 93, so a main body does not need to be increased in size and thus a main body is prevented from being scaled up.

After that, the recording medium having the reference image formed thereon successively passes through the duplex conveying rollers 79, the registration rollers 75, the secondary transferring portion 76, and the heat roller fixing apparatus 8 to be discharged to the delivery tray 65 (refer to FIG. 1).

As in this embodiment, the density sensor 9 is more preferably disposed within the horizontal duplex conveying path. The following points are given for explaining this reason. When the density sensor is disposed in a reverse conveying path, the recording medium passes through a sensor opposing portion twice. Thus there is required control means for detecting the density only when the recording medium having the stabilized density passes through the sensor opposing portion for the second time. However, when the density sensor is disposed in the duplex conveying path, the density has only to be detected when the recording medium passes through the sensor opposing portion once, and thus an image becoming a trigger has only to be formed on the recording medium. Hence, the cost can be reduced.

In addition, in the case of the reverse conveying path portion, a sufficient straight conveying path cannot be ensured in order to measure the density, and a leading edge of the recording medium collides with a curved conveying path during the density measurement. Since the recording medium is moved vertically with respect to the density sensor due to the collision shock, the density cannot be measured with high accuracy. This reason, as well known, is that the normal optical sensor is weak in the vertical movement. When an object to be measured is vertically moved, a value of an output of the normal optical sensor largely changes.

Moreover, when the density sensor is provided in the reverse conveying path, a sensor light receiving portion is directed nearly in a horizontal direction in many cases. Thus, there is a possibility that the light receiving portion of the density sensor is influenced by the scattered toner or paper dust. While a cover, a shutter or the like may be provided as a measure to cope with such a situation, this leads to cost-up. In addition, in the image forming apparatus which is in the course of promoting a high speed operation in recent years, there is a possibility that a distance required for the cooling cannot be sufficiently ensured in the case of the reverse conveying path portion. Thus cooling means such as a fan must be introduced as a measure to cope with this situation. As a result, as a matter of course, the cost increases. Moreover, since the recording medium is vertically moved due to an influence of the air ejected from the cooling fan, the density cannot be adjusted with high accuracy due to the vertical movement of the recording medium.

Here, as shown in FIG. 2, the density sensor 9 is disposed in a duplex horizontal conveying path 93 (straight conveying path) along which the recording medium can be conveyed nearly in a horizontal direction through the reverse conveying path 66, a feeding portion in the vicinity of the reverse rollers 78, and the like. Also, since the light receiving surface of the density sensor 9 is disposed downward, the density sensor 9 is hardly influenced by the scattered toner, paper dust, or the like. Note that when the density sensor 9 is disposed in a position which is distant from the curved conveying path 94 located on a downstream side with respect to the duplex horizontal conveying path 93 by a distance longer than a maximum size of the recording medium used for the image adjustment, since the leading edge of the recording medium does not collide with the curved conveying path 94, the recording medium is prevented from being vertically moved due to the collision shock. As a result, the density can be stably adjusted since the influence by the vertical movement of an object to be measured which is a problem in the scanning type sensor is largely suppressed.

In addition, when the density measuring sensor 9 cannot be disposed in the position which is distant from the curved conveying path 94 located on the downstream side with respect to the duplex horizontal conveying path 93 by a distance longer than the maximum size of the recording medium used for the image adjustment, if the density is measured by the density sensor 9 only for a period of time until the leading edge of the recording medium for the density image adjustment is conveyed to the curved conveying path 94, the density can be stably adjusted since the influence by the vertical movement of an object to be measured is largely suppressed.

Moreover, a roller interval between upstream rollers 95 provided on an immediately upstream side of the density sensor 9, and downstream rollers 96 provided on an immediately downstream side of the density sensor 9 is made shorter than a minimum size of the recording medium used for the image density adjustment, and a recording medium conveying speed in the downstream roller 96 is set equal to or higher than that in the upstream rollers 95, whereby the vertical movement of the recording medium can be more largely suppressed, and the density can be more stably adjusted.

Note that white light, or Red, Blue or Green light, or the like which is emitted from an LED, a halogen lamp, a xenon lamp, or the like may be used as the reference light for the density sensor 9, and a CCD, a photodiode, a photomultiplier, a CMOS sensor, or the like may be used as a photoelectric conversion element provided within the light receiving means 92.

As set forth hereinabove, according to this embodiment, in the image forming apparatus for detecting the density of an image on the recording medium after the image is heated and adjusting the image density, the image density is detected after the density of the image on the recording medium is stabilized after completion of the fixing process. Hence, the image density can be stably adjusted with high accuracy.

While in this embodiment, the development is carried out using the rotation type developing devices, the present invention is not intended to be limited thereto and thus a developing device having any form can be applied to the present invention as long as the effects of the present invention are obtained.

This application claims priority from Japanese Patent Application No. 2004-168468 filed Jun. 7, 2004, which is hereby incorporated by reference herein.

What is claimed is:

1. An image forming apparatus, comprising:

image forming means which forms an image on a recording material using toner containing wax;

heating means which heats the image formed on the recording material by the image forming means;

a conveying path along which the recording material heated by the heating means is conveyed;

density detecting means disposed in the conveying path for detecting density of the image on the recording material heated by said heating means; and adjustment means for adjusting the density of the image formed on the recording material, based on detection results detected by the density detecting means, wherein said density detecting means is disposed in a position where a temperature of the wax heated by the heating means is equal to or lower than a coagulation temperature of the wax, and wherein an interval of conveying members which are disposed on an immediately upstream side and an immediately downstream side with respect to said density detecting means, respectively, is set as being made shorter than a minimum size of a recording material for image density adjustment, and the density of the image is detected with the recording material being held by the conveying members.

2. An image forming apparatus according to claim 1, wherein a recording material conveying speed of the conveying member disposed on the right downstream side with respect to said density detecting means is equal to or higher than a recording medium conveying speed of the conveying member disposed on the right upstream side with respect to the density detecting means.

* * * * *

UNITED STATES PATENT AND TRADEMARK OFFICE

CERTIFICATE OF CORRECTION

PATENT NO. : 7,224,916 B2
APPLICATION NO. : 11/144595
DATED : May 29, 2007
INVENTOR(S) : Tadashi Iwakawa It is certified that error appears in the above-identified patent and that said Letters Patent is hereby corrected as shown below:

COLUMN 2:
Line 43, “long” should read --a long--.

COLUMN 3:
Line 16, “cross sectional” should read --cross-sectional--.
Line 18, “cross sectional” should read --cross-sectional--.
Line 22, “cross sectional” should read --cross-sectional--.
Line 28, “cross sectional” should read --cross-sectional--.
Line 30, “cross sectional” should read --cross-sectional--.
Line 41, “cross sectional” should read --cross-sectional--.

COLUMN 4:
Line 41, “hest-fixing” should read --best-fixing--.

COLUMN 5:
Line 34, “recede” should read --to recede--.
Line 48, “cross sectional” should read --cross-sectional--.
Line 50, “cross sectional” should read --cross-sectional--.

COLUMN 6:
Line 21, “will(be” should read --will be--.
Line 52, “toner” should read --toner particles--.

COLUMN 7:
Line 35, “appeared” should read --which appeared--.

COLUMN 8:
Line 36, “so” should read --so that--.

COLUMN 9:
Line 10, “cost-up.” should read --increased cost.--.

UNITED STATES PATENT AND TRADEMARK OFFICE

CERTIFICATE OF CORRECTION

PATENT NO. : 7,224,916 B2
APPLICATION NO. : 11/144595
DATED : May 29, 2007
INVENTOR(S) : Tadashi Iwakawa It is certified that error appears in the above-identified patent and that said Letters Patent is hereby corrected as shown below:

COLUMN 10:
Line 4, "Red, Blue or Green" should read --red, blue or green--.

Signed and Sealed this

Eleventh Day of December, 2007

JON W. DUDAS
*Director of the United States Patent and Trademark Office*